US006035829A

United States Patent [19]

Hartke et al.

[11] Patent Number: 6,035,829

[45] Date of Patent: Mar. 14, 2000

[54] METHOD OF SPECIFYING AN INJECTION-PRESSURE SETPOINT VALUE IN AN ACCUMULATOR INJECTION SYSTEM

[75] Inventors: Andreas Hartke, Regensburg; Klaus Wenzlawski, Nürnberg; Christian Birkner, Irlbach, all of Germany

[73] Assignee: Siemens Aktiengesellschaft, Munich, Germany

[21] Appl. No.: 09/229,927

[22] Filed: Jan. 13, 1999

[30] Foreign Application Priority Data

Jan. 13, 1998 [DE] Germany ..... 198 00 940

[51] Int. Cl.[7] ..... F02M 7/00

[52] U.S. Cl. ..... 123/447; 123/456; 123/357

[58] Field of Search ..... 123/447, 446, 123/357, 456

[56] References Cited

U.S. PATENT DOCUMENTS

| | | | |
|---|---|---|---|
| 5,456,233 | 10/1995 | Felhofer | 123/447 |
| 5,642,714 | 7/1997 | Buckley | 123/447 |
| 5,642,716 | 7/1997 | Ricco | 123/456 |
| 5,678,521 | 10/1997 | Thompson | 123/447 |
| 5,746,180 | 5/1998 | Jefferson | 123/447 |
| 5,749,345 | 5/1998 | Treml | 123/456 |
| 5,758,622 | 6/1998 | Rembold | 123/456 |
| 5,941,214 | 8/1999 | Hoffman | 123/447 |

*Primary Examiner*—Carl S. Miller

*Attorney, Agent, or Firm*—Herbert L. Lerner; Laurence A. Greenberg

[57] ABSTRACT

An injection-pressure setpoint value for the pressure accumulator of an accumulator injection system is specified as a function of the operating point of the engine. The setpoint is specified with the aid of respectively separate characteristic diagrams for the start, idling and load engine operating states. In load operation, the profile of the injection-pressure setpoint value is additionally adapted to the particular requirements of the transient engine operation with a first timing element whose timing characteristics depend on the engine speed. The profile may be briefly raised out of a low engine speed in the case of an acceleration. With the aid of a downstream, second timing element which is independent of the first timing element, sudden transitions in the specification of the setpoint values when the engine operating state changes are suitably smoothed out. Any jumps in the injection-pressure setpoint value are avoided. The gear which has been engaged or the driving style of the driver can be taken into account in the transfer characteristics of the second timing element.

7 Claims, 4 Drawing Sheets

METHOD OF SPECIFYING AN INJECTION-PRESSURE SETPOINT VALUE IN AN ACCUMULATOR INJECTION SYSTEM

BACKGROUND OF THE INVENTION

Field of the Invention

The invention lies in the automotive arts. In particular, the invention relates to a method of specifying the injection-pressure setpoint value in accumulator injection systems for supplying fuel in internal combustion engines.

Use is increasingly made of accumulator injection systems for supplying fuel in internal combustion engines. Such accumulator injection systems operate at very high injection pressures. Such injection systems are known as common-rail injection systems (for diesel engines) and HPDI injection systems (for spark ignition Otto engines). These injection systems are distinguished by the fact that the fuel is fed, using a high-pressure pump, into a pressure accumulator which is common to all cylinders and from which the injectors or injection valves at the individual cylinders of the engine are supplied. The opening and closing of the injection valves is as a rule controlled electromagnetically. The injected quantity of fuel is proportional to the opening duration of the injection valve and to the system pressure or injection pressure which is measured by means of a pressure sensor on the pressure accumulator.

The injection pressure in such a system is independent of the engine speed and therefore constitutes an additional variable which makes it possible to inject the fuel in dependence on the demand. The injection pressure has a considerable influence on the combustion process in the cylinder, by means of, for example, the atomization of the fuel as a function thereof. By raising the injection pressure in the lower rotational speed range it is possible to improve the exhaust gas values, for example. Generally the procedure is always to prescribe an injection pressure which is adapted to the engine operating point and the operating state, in order to obtain combustion which is at an optimum in terms of the emission of pollutants, the combustion noise and the generation of torque.

In the prior art, the injection pressure was specified, in particular in the case of the common-rail system, solely by means of a single characteristic diagram which is addressed via the currently injected quantity of fuel and the current engine speed. Transition states which result, for example, when accelerating out of a transient, non-steady engine operating state, cannot be adequately taken into account in such a procedure.

SUMMARY OF THE INVENTION

The It is accordingly an object of the invention to provide a method of specifying the injection-pressure setpoint value in an accumulator injection system, which overcomes the above-mentioned disadvantages of the heretofore-known methods of this general type and which takes into account the specific requirements which are made of the time profile of the setpoint variable and which result from a transient engine operating state.

With the foregoing and other objects in view there is provided, in accordance with the invention, a method of specifying an injection-pressure setpoint value in an accumulator injection system for a fuel supply in an internal combustion engine, which comprises:

defining a load-mode characteristic diagram for an injection-pressure base value in a load mode of an internal combustion engine, a start characteristic diagram for an injection-pressure base value when the engine is started, and an idle characteristic diagram for an injection-pressure base value during idling of the engine;

outputting an output of the load-mode characteristic diagram to a first differential $DT_1$ timing element having a timing characteristics dependent on an engine speed; and inputting into a second $PT_1$ delay timing element an output of the first timing element, an output of the start characteristic diagram, an output of the idle characteristic diagram, and an output of a characteristic diagram for specifying a basic timing constant;

outputting the injection-pressure setpoint value for a respective operating state of the internal combustion engine with the second $PT_1$ delay timing element; and setting the pressure in a pressure accumulator of the fuel injection system in accordance with the injection-pressure setpoint value as a function of the operating state of the internal combustion engine.

In other words, the objects of the invention are satisfied by specifying the injection-pressure setpoint value as a function of the operating point with the aid of, in each case, separate characteristic diagrams for the start, idling and load engine operating states.

In accordance with an added feature of the invention, the injection-pressure base value of the load-mode characteristic diagram is modified with a coolant-temperature dependent characteristic curve.

In accordance with an additional feature of the invention, timing constants and an amplification factor are specified for the first timing element, by means of respective characteristic curves, as a function of the engine speed.

In load mode, the profile of the injection-pressure setpoint value is additionally adapted to the particular requirements of the transient engine operation by means of a first timing element whose timing characteristics depend on the engine speed. In this way, it is possible, for example when accelerating out of a low engine speed, to briefly raise the injection pressure in order to compensate for the tendentially poorer preparation of mixtures at lower engine speeds by means of an increase in injection pressure and thus better atomization of fuel. Conversely, by means of a brief reduction in the injection pressure when there is a sudden load requirement at a high engine speed it is possible to reduce the noise emissions. Transitions in the specification of setpoint values when the engine operating state changes are suitably smoothed out with the aid of a second timing element which is independent of the first timing element. In this way, sudden jumps in the injection-pressure setpoint value, such as would occur without appropriate countermeasures at the changeover from the starting mode (increased injection pressure) into idling (reduced injection pressure), for example, can be avoided. As a result, sudden changes in the drive torque of the high-pressure pump, for example at the transition into idling or out of idling, are avoided. In addition to lower loading of the components of the injection system, the increased stability of the rotational speed results in a substantial improvement in comfort for the vehicle occupants.

In accordance with another feature of the invention, an output of the characteristic diagram for the basic timing constant for the second timing element is modified with a characteristic diagram for a currently engaged gear and a driving characteristic of a driver.

In accordance with a further feature of the invention, a signal relating to an engine operating state is input into the second timing element.

The second timing element can thus also be used to superimpose a change limitation on the injection pressure in load mode. For this purpose, the timing characteristics of the transfer function of the timing element are correspondingly prescribed as a function of the gear which has been engaged or the driving style of the driver. In this way, allowance can be made for the driving characteristics of the vehicle driver or for a particular situation, and the engine tuning in the direction of a specific effect, for example a maximum generation of torque is postponed. Such tuning is usually performed as a compromise between fuel consumption, the generation of torque, the emission of pollutants, and the noise characteristics.

In accordance with again an added feature of the invention, the first timing element is operated with the following transfer function, in recursive form:

$$FUP_SP_PL_DYN(i) = \frac{1}{1 + T_1 / t_a}\left[\begin{array}{c} K_{PDT1}(FUP_SP_PL(i) + T_2 / t_a(FUP_SP_PL(i) - FUP_SP_PL(i-1))) \\ T_1 / t_a(FUP_SP_PL_DYN(i-1)) \end{array}\right]$$

where FUP_SP_PL_DYN(i) represents an output signal of the first timing element, $K_{PDT1}$ represents an amplification factor, $T_1$ is a first timing constant, $T_2$ is a second timing constant, FUP_SP_PL(i) represents an injection-pressure setpoint in load mode, $t_a$ is a sampling time, and wherein the index i designates a current computational run and i−1 designates a preceding computation.

In accordance with a concomitant feature of the invention, the second timing element is operated with the following transfer function, in recursive form:

$$FUP_SP_DFT(i) = \frac{1}{1 + T_1 / t_a}[T_1 / t_a(FUP_SP_DFT(i-1)) + FUP_SP(i)]$$

where FUP_SP_DFT(i) represents a delayed injection-pressure setpoint value, FUP_SP(i) represents a current injection-pressure setpoint value, $T_1$ is a timing constant of the delay timing element, $t_a$ represents a sampling time, and wherein the index i designates a current computational run and i−1 designates a preceding computation.

The invention thus makes it possible to change the injection pressure in real time as a function of the operating point, and thus to achieve optimum adaptation of the injection pressure profile to the particular requirements of the transient engine operation.

Other features which are considered as characteristic for the invention are set forth in the appended claims.

Although the invention is illustrated and described herein as embodied in a method for the specification of the injection-pressure setpoint value in accumulator injection systems, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
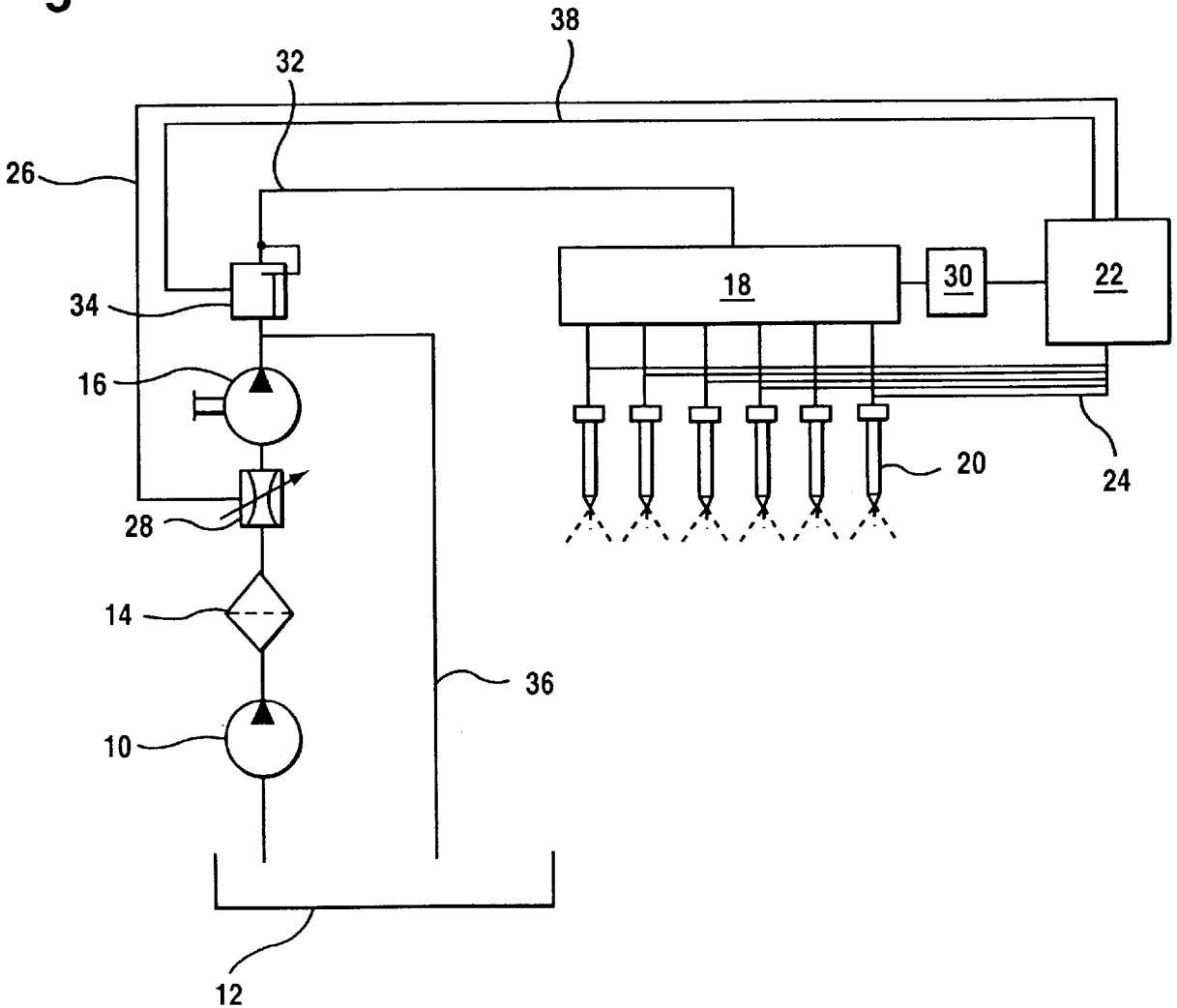
FIG. 1 is a schematic diagram of a common-rail fuel injection system.

Referring now to the figures of the drawing in detail and first, particularly, to FIG. 1 thereof, there is seen a fuel injection system that is generally known as a common-rail system and is used, especially, in diesel engines. The fuel is aspirated in from a fuel vessel 12 by means of an advance feed pump 10. The advance feed pump 10 feeds the fuel via a fuel filter 14 to a high-pressure pump 16 which feeds the fuel under high pressure into a pressure accumulator 18. The pressure accumulator 18 is connected to injection valves 20 via which the fuel is injected into the cylinders of the internal combustion engine. The injection process is controlled by an electronic control unit 22 which is connected to the individual injection valves 20 via signal lines 24.

The electronic control unit 22 also acts, via a control line 26, on an intake throttle valve 28 which is arranged in the fuel line between the advance feed pump 10 and the high-pressure pump 16. The valve 28 can be used to regulate the feed flow of the high-pressure pump 16 in order to set the volume flow of the high-pressure pump 16 as a function of demand. The feed flow of the high-pressure pump 16 can, however, also alternatively be changed in another way, for example a corresponding pressure-dependent or rotational speed-dependent configuration of the advance feed pump 10.

A pressure sensor 30, which senses the pressure prevailing in the pressure accumulator 18, is mounted on the pressure accumulator 18. The output signal of the pressure sensor 30 is fed to the electronic control unit 22.

A pressure regulating valve 34 is connected into the fuel line 32 between the high-pressure pump 16 and the pressure accumulator 18 in order to set the pressure in the pressure accumulator 18 as a function of the operating conditions of the internal combustion engine. The pressure regulating valve 34 conducts excess fuel, which is not required to maintain a desired pressure in the pressure accumulator 18, back into the fuel vessel 12 via a fuel return line 36. The pressure regulating valve 34 is connected via a control line 38 to the electronic control unit 22 which outputs to the pressure regulating valve 34 a drive signal that determines the pressure in the pressure accumulator 18.

As a function of the input signals which are fed in from the outside and which include the output signal of the pressure sensor 30, the engine speed and further information, such as information on the gear which has been engaged, and as a function of internally defined variables such as the currently injected quantity of fuel, the electronic control unit 22 determines the pressure which is to be applied to the injection valves 20. The pressure is referred to as the setpoint pressure in the pressure accumulator 18 or the injection-pressure setpoint value. Corresponding signals are then transmitted to the pressure regulating valve 34 and/or the high-pressure pump 16 via the control lines 26 and 38.

Figure 2:
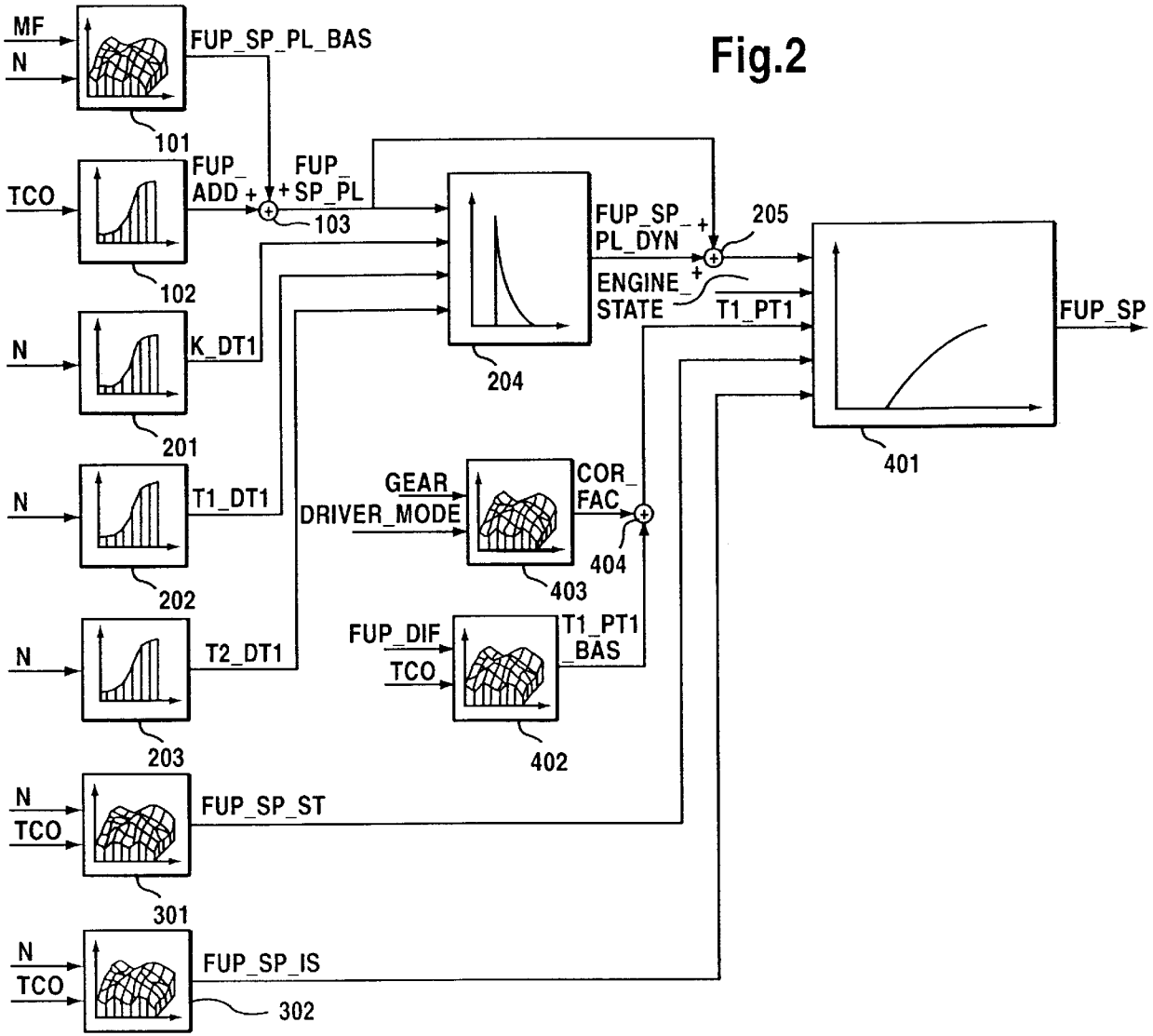
FIG. 2 is a schematic block diagram illustrating the specification of the injection-pressure setpoint value in the system of FIG. 1.

Referring now to FIG. 2, there is shown a schematic block illustration of the specification of the injection-pressure setpoint value by the electronic control unit 22.

With the aid of the characteristic diagrams 101, 301 and 302, corresponding setpoint values FUP_SP_ST, FUP_SP_IS and FUP_SP_PL_BAS for the injection pressure are prescribed for the start ST (characteristic diagram 301), idling IS (characteristic diagram 302) and load mode PL (characteristic diagram 101) engine operating states. Here, the setpoint value characteristic diagrams for the start and the idling are addressed via the current engine speed N and the coolant temperature TCO, in order to make allowance for the dependence of the preparation of the mixtures on the charge movement in the combustion space and the temperature of the engine.

By referring back to a prescribed characteristic diagram 102, the setpoint value FUP_SP_BL_BAS, prescribed in load mode as a function of the operating point for the injection pressure in the summation point 103 is corrected additively as a function of the coolant temperature to form FUP_SP_PL. The setpoint value FUP_SP_PL which is determined in this way for the load mode is present at a first timing element 204 and is also fed to a second timing element 401, having been modified additively in a summation point 205 by the output signal of the first timing element 204. The setpoint values FUP_SP_ST and FUP_SP_IS from the characteristic diagrams 301 and 302 for the operating states start and idling are also present at the second timing element 401.

The first timing element 204 is designed as a $DT_1$ element. The recursive equation for the transfer function of this timing element 204 is (equation 1)

$$FUP_SP_PL_DYN(i) = \frac{1}{1 + T_1/t_a}\left[\begin{array}{c} K_{PDT1}(FUP_SP_PL(i) + T_2/t_a(FUP_SP_PL(i) - FUP_SP_PL(i-1))) \\ T_1/t_a(FUP_SP_PL_DYN(i-1)) \end{array}\right]$$

where

FUP_SP_PL_DYN(i): output signal of first timing element;

FUP_SP_PL(i): Injection-pressure setpoint in load mode;

$K_{PDT1}$: Amplification factor;

$T_1$: First timing constant;

$T_2$: Second timing constant;

$t_a$: Sampling time.

The index i denotes here the current computational run, i−1 denotes the preceding computation.

Figure 3:
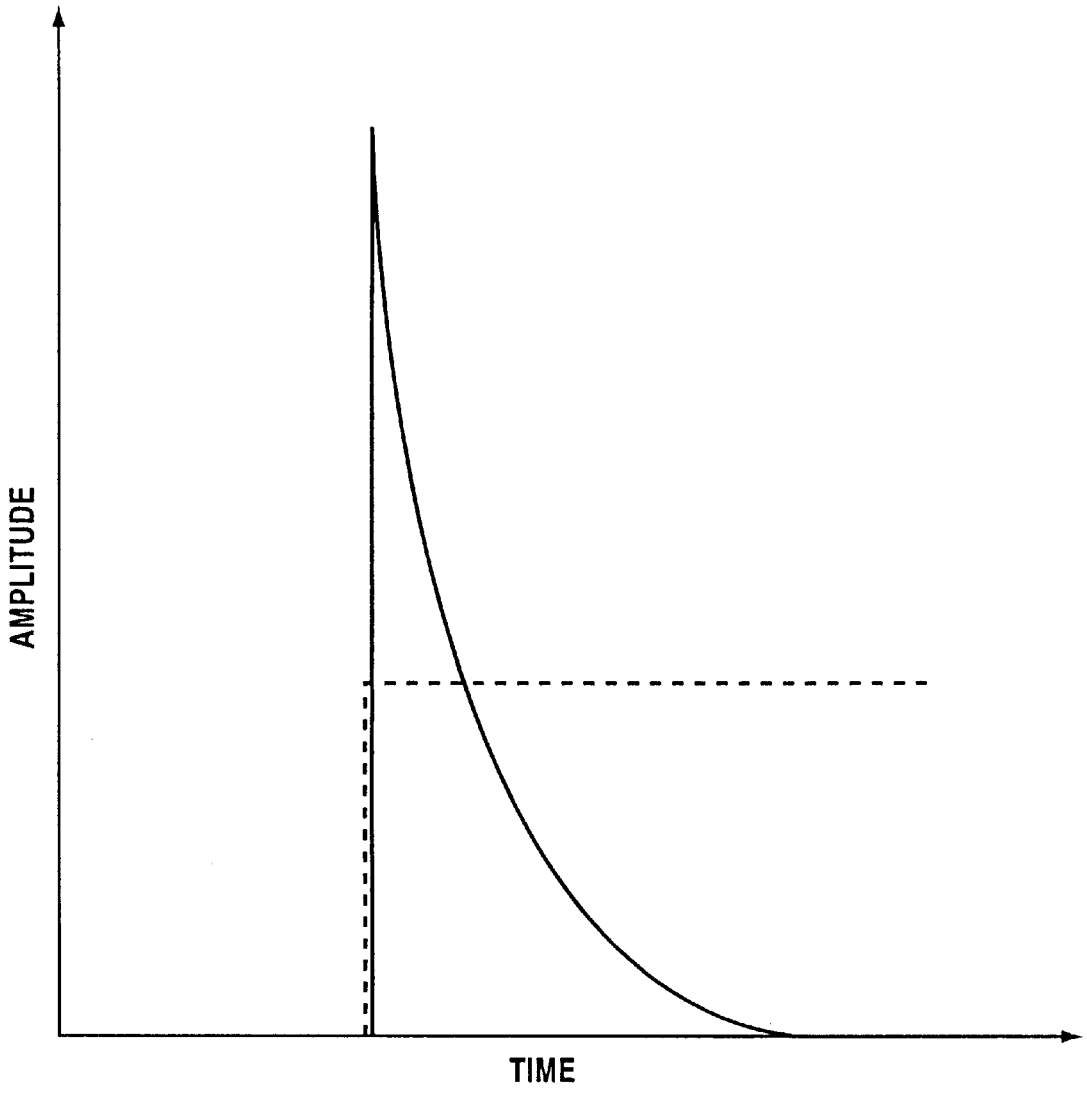
FIG. 3 is a graph showing the step response of the first transmission timing element in the block diagram of FIG. 2.

FIG. 3 shows the step response of the first timing element 204. With the aid of this timing element it is possible, depending on the selection of the sign of the amplification factor, to raise or lower the setpoint value for the injection pressure in the case of a step-like change, for example of the injected quantity of fuel, with adapted timing characteristics. The timing constants $T_1$, $T_2$ and the amplification factor $K_{PDT1}$ for the first $DT_1$ timing element 204 are obtained from characteristics curves 201, 202 and 203 which are prescribed as a function of engine speed, in order to tune the setpoint value intervention as a function of the engine speed by means of the first timing element 204.

Figure 4:
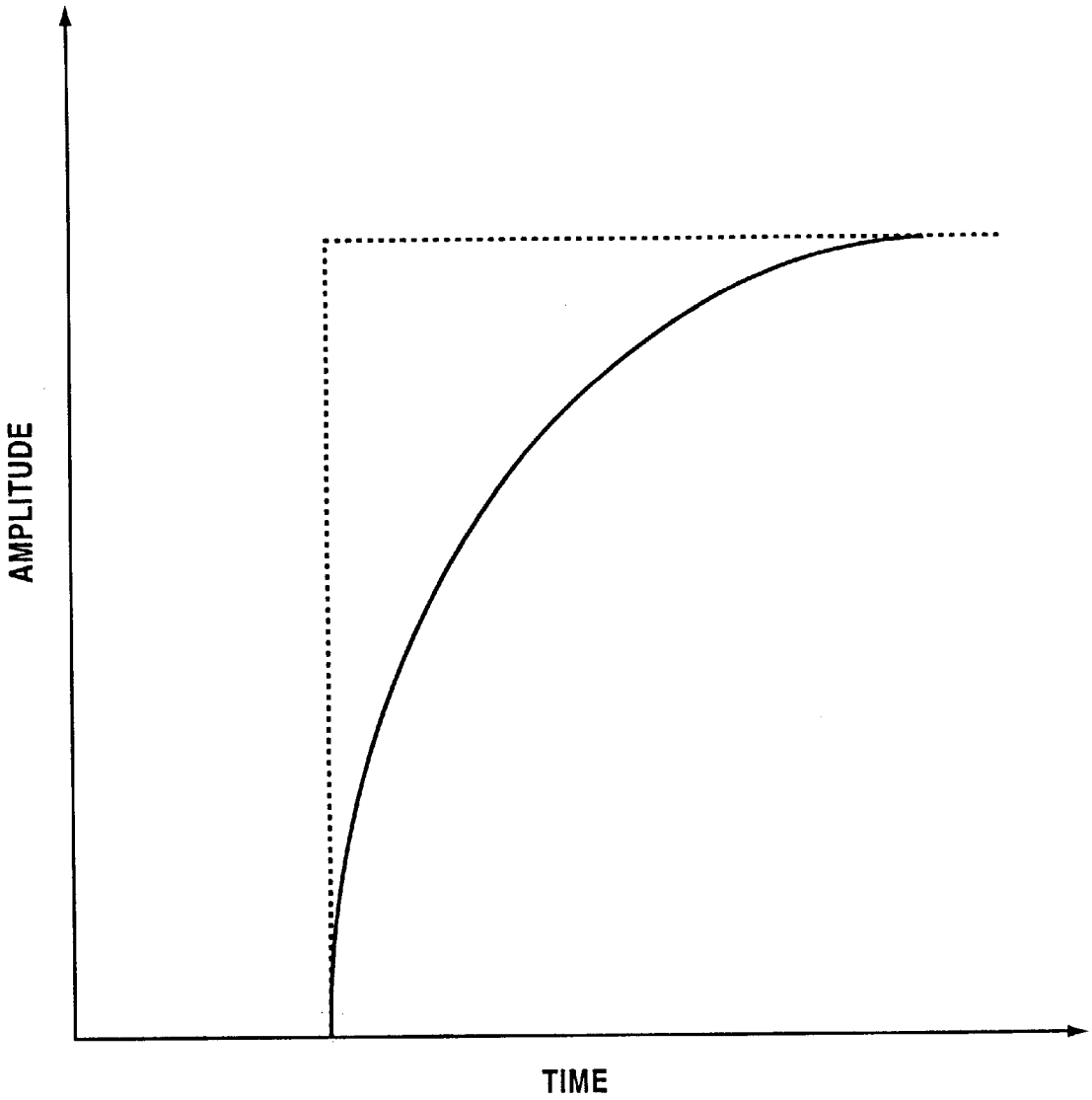
FIG. 4 is a graph showing the step response of the second transmission timing element in the block diagram of FIG. 2.

The second timing element 401 which is connected downstream of the first timing element 204 is designed as a delay element of the first order ($PT_1$ element). The equation for the transfer function of this timing element 401, whose step response is illustrated in FIG. 4, is, in recursive form, (equation 2)

$$FUP_SP_DFT(i) = \frac{1}{1 + T_1/t_a}[T_1/t_a(FUP_SP_DFT(i-1)) + FUP_SP(i)]$$

where

FUP_SP_DFT(i): Delayed injection-pressure setpoint value;

FUP_SP(i): Current injection-pressure setpoint value;

$T_1$: Timing constant of the delay timing element;

$t_a$: Sampling time.

Again, the index i denotes the current computational run, and i−1 denotes the preceding computation.

The variable FUP_SP in the equation (2) is described here as a function of the engine operating state, either with FUP_SP_ST for the engine start, with FUP_SP_IS for the engine idling or with FUP_SP_PL for the load mode. For this purpose, the timing element 401 is additionally informed, in coded form, of the engine operating state via the input ENGINE-STATE. The specification of the basic time constants T1_PT1_BAS for the $PT_1$ timing element 401 is carried out by means of the characteristic diagram 402 as a function of the coolant temperature TCO and the current control difference FUP_DIF between the injection setpoint pressure and injection actual pressure in the high-pressure accumulator, in order to make allowance for the characteristics of the preparation of the mixtures, which are dependent on the engine temperature, and for the timing characteristics of the injection system, which are different for the building up of pressure and reduction of pressure. As a function of the gear which has been engaged and the result of a driver detection, this basic timing constant is subjected to multiplicative weighting at a multiplication point 404 before it is fed, as ultimate timing constant, to the timing element 401 and is processed there in the form of the variable T1 according to equation (2). The weighting is carried out with the aid of the characteristic diagram 403.

The information relating to the gear which has been engaged is contained in coded form in the signal GEAR, which is applied to the characteristic diagram 403 as an input variable. If appropriate, the signal DRIVER_MODE of the driver detection function of a transmission controller for an automatic transmission is applied to a further input of the characteristic diagram 403.

By referring to the information relating to the general driving characteristics of the driver, which information is usually determined by means of a fuzzy system in modern transmission controls or is prescribed by the driver by activating a switch, the building up of pressure and the reduction of pressure in the high-pressure accumulator can thus be accelerated or delayed in a selective fashion in comparison with the prescribed timing characteristics in order, for example, to make allowances for the desire of the driver for optimum generation of torque.

The setpoint value FUP_SP, obtained in the described form at the output of the timing element 401, for the injection pressure is fed to the injection pressure regulator in the electronic control unit 22 as an input signal, which regulator ensures that the injection pressure which is the optimum one for specific operating characteristics is set in the pressure accumulator 18 of the fuel supply system.

We claim:

1. A method of specifying an injection-pressure setpoint value in an accumulator injection system for a fuel supply in an internal combustion engine, which comprises:

defining a load-mode characteristic diagram for an injection-pressure base value in a load mode of an internal combustion engine, a start characteristic diagram for an injection-pressure base value when the engine is started, and an idle characteristic diagram for an injection-pressure base value during idling of the engine;

outputting an output of the load-mode characteristic diagram to a first differential $DT_1$ timing element having a timing characteristics dependent on an engine speed; and inputting into a second $PT_1$ delay timing element an output of the first timing element, an output of the start characteristic diagram, an output of the idle characteristic diagram, and an output of a characteristic diagram for specifying a basic timing constant;

outputting the injection-pressure setpoint value for a respective operating state of the internal combustion engine with the second $PT_1$ delay timing element; and setting the pressure in a pressure accumulator of the fuel injection system in accordance with the injection-pressure setpoint value as a function of the operating state of the internal combustion engine.

2. The method according to claim 1, which further comprises modifying the injection-pressure base value of the load-mode characteristic diagram with a coolant-temperature dependent characteristic curve.

3. The method according to claim 1, which comprises specifying, as a function of the engine speed, timing constants and an amplification factor for the first timing element with respective characteristic curves.

4. The method according to claim 1, which comprises modifying an output of the characteristic diagram for the basic timing constant for the second timing element with a characteristic diagram for a currently engaged gear and a driving characteristic of a driver.

5. The method according to claim 1, which comprises inputting a signal relating to an engine operating state at the input of the second timing element.

6. The method according to claim 1, which comprises operating the first timing element with the following transfer function, in recursive form:

$$FUP_SP_PL_DYN(i) = \frac{1}{1 + T_1 / t_a}\left[\begin{array}{c} K_{PDT1}(FUP_SP_PL(i) + T_2 / t_a(FUP_SP_PL(i) - FUP_SP_PL(i-1))) \\ T_1 / t_a(FUP_SP_PL_DYN(i-1)) \end{array}\right]$$

where FUP_SP_PL_DYN(i) represents an output signal of the first timing element, $K_{PDT1}$ represents an amplification factor, $T_1$ is a first timing constant, $T_2$ is a second timing constant, FUP_SP_PL(i) represents an injection-pressure setpoint in load mode, $t_a$ is a sampling time, and wherein the index i designates a current computational run and i−1 designates a preceding computation.

7. The method according to claim 1, which comprises operating the second timing element with the following transfer function, in recursive form:

$$FUP_SP_DFT(i) = \frac{1}{1 + T_1 / t_a}[T_1 / t_a(FUP_SP_DFT(i-1)) + FUP_SP(i)]$$

where FUP_SP_DFT(i) represents a delayed injection-pressure setpoint value, FUP_SP(i) represents a current injection-pressure setpoint value, $T_1$ is a timing constant of the delay timing element, $t_a$ represents a sampling time, and wherein the index i designates a current computational run and i−1 designates a preceding computation.

* * * * *